US005765704A

United States Patent [19]

Cameron

[11] Patent Number: 5,765,704

[45] Date of Patent: Jun. 16, 1998

[54] BABY BOTTLE HOLDER

[76] Inventor: Linda Cameron, 1529 Goodview Ave., Amherstburg, Ontario, Canada, N9V 1T1

[21] Appl. No.: 811,019

[22] Filed: Mar. 4, 1997

[51] Int. Cl.[6] ..... A61J 9/06

[52] U.S. Cl. ..... 215/11.6; 215/11.1; 215/11.3

[58] Field of Search ..... 215/11.1, 11.3, 215/11.6

[56] References Cited

U.S. PATENT DOCUMENTS

| | | | |
|---|---|---|---|
| 2,793,778 | 5/1957 | Maxwell | 215/11.1 X |
| 3,648,873 | 3/1972 | Grobbel | 215/11.3 |
| 4,796,767 | 1/1989 | McKeown | 215/11.3 X |
| 4,880,125 | 11/1989 | LeBeau | 215/11.3 |
| 4,979,629 | 12/1990 | Askerneese | 215/11.3 X |
| 5,078,287 | 1/1992 | Holmes, III | 215/11.1 |
| 5,109,996 | 5/1992 | Sullivan | 215/11.6 |
| 5,193,239 | 3/1993 | Dolce et al. | 7/152 |
| 5,301,825 | 4/1994 | Di Scala et al. | 215/11.3 X |
| 5,356,016 | 10/1994 | Wiedemann | 215/11.3 |
| 5,524,783 | 6/1996 | Popoff | 215/11.6 X |

*Primary Examiner*—Sue A. Weaver
*Attorney, Agent, or Firm*—Henderson & Sturm

[57] ABSTRACT

An improved baby bottle holder (10) is used with a baby bottle (100) having a collapsible liner (104) suspended with an open ended liner support member (102). The baby bottle holder (10) comprises an insulated base member (20) provided with an insert member (30) equipped with a vertical support component (31) and a horizontal support component (32) for applying dual axis compressive forces to the collapsible liner (104).

6 Claims, 2 Drawing Sheets

BABY BOTTLE HOLDER

BACKGROUND OF THE INVENTION

1. Field of the Invention

The present invention relates to the field of baby bottle constructions in general, and in particular to an improved baby bottle holder for baby bottles having collapsible liners.

2. Description of Related Art

As can be seen by reference to the following U.S. Pat. Nos. 5,078,287; 5,109,996; 5,193,239; and 5,356,016; the prior art is replete with myriad and diverse baby bottle constructions.

While all of the aforementioned prior art constructions are more than adequate for the basic purpose and function for which they have been specifically designed, none of them provide dual axis pressure on a collapsible bottle liner to insure that virtually no air remains entrapped within the bottle liner prior to allowing the baby to drink from the bottle.

As most parents and physicians have been aware for a long period of time, the most common cause of gastric distress in infants in the presence of entrained air in liquids delivered to infants in baby bottles.

As a consequence of the foregoing situation, there has existed a longstanding need among those individuals involved in child care for a new type of bottle holder for use in conjunction with collapsible bottle liners that will apply dual axis pressure on the periphery of the collapsible liner to force entrained air out of the liner and the provision of such a construction is a stated objective of the present invention.

SUMMARY OF THE INVENTION

Briefly stated, the improved baby bottle holder that forms the basis of the present invention comprises a base unit which is dimensioned to receive a collapsible baby bottle liner.

As will be explained in greater detail further on in the specification, the base unit is insulated to maintain the temperature of the contents of the collapsible liner, and is further provided with a dual axis compression applying unit that will cooperate with the liner support unit to compress the contents of the collapsible liner to force entrained air out of the baby bottle.

BRIEF DESCRIPTION OF THE SEVERAL VIEW OF THE DRAWING

These and other attributes of the invention will become more clear upon a thorough study of the following description of the best mode for carrying out the invention, particularly when reviewed in conjunction with the drawings, wherein.

DETAILED DESCRIPTION OF THE INVENTION

Figure 1:
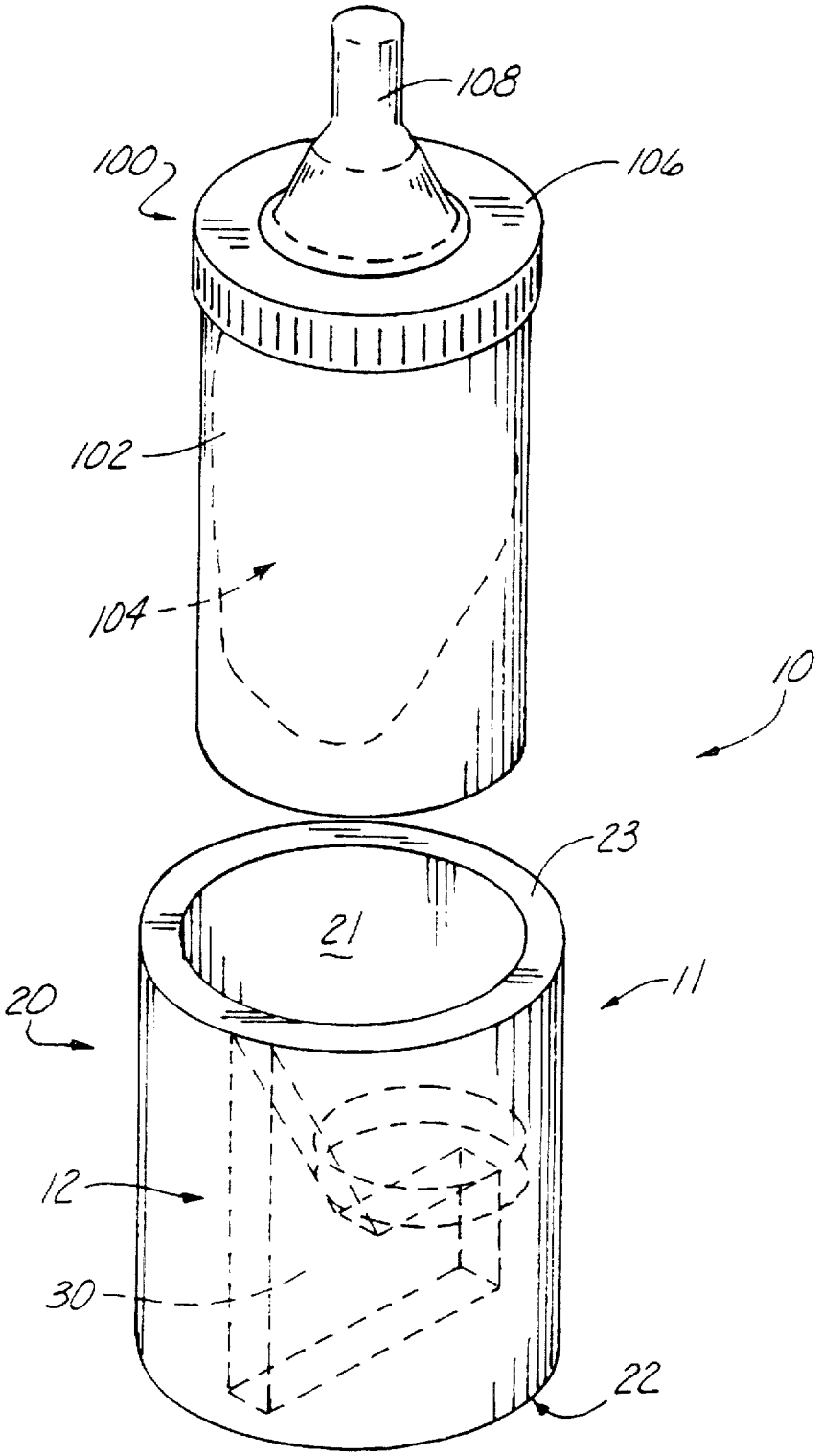
FIG. 1 is an exploded perspective view of the improved baby bottle holder that forms the basis of the present invention.

As can be seen by reference to the drawings, and in particularly to FIG. 1, the improved baby bottle holder that forms the basis of the present invention is designated generally by the reference number 10. The baby bottle holder 10 comprises in general, a base unit 11, and a dual axis compressive force applying unit 12. These units will now be described in seriatim fashion.

Prior to embarking on a detailed description of the baby bottle holder 10, it would first be advisable to describe the conventional baby bottle designated generally as 100 that this invention was designed to operate in conjunction with.

Figure 2:
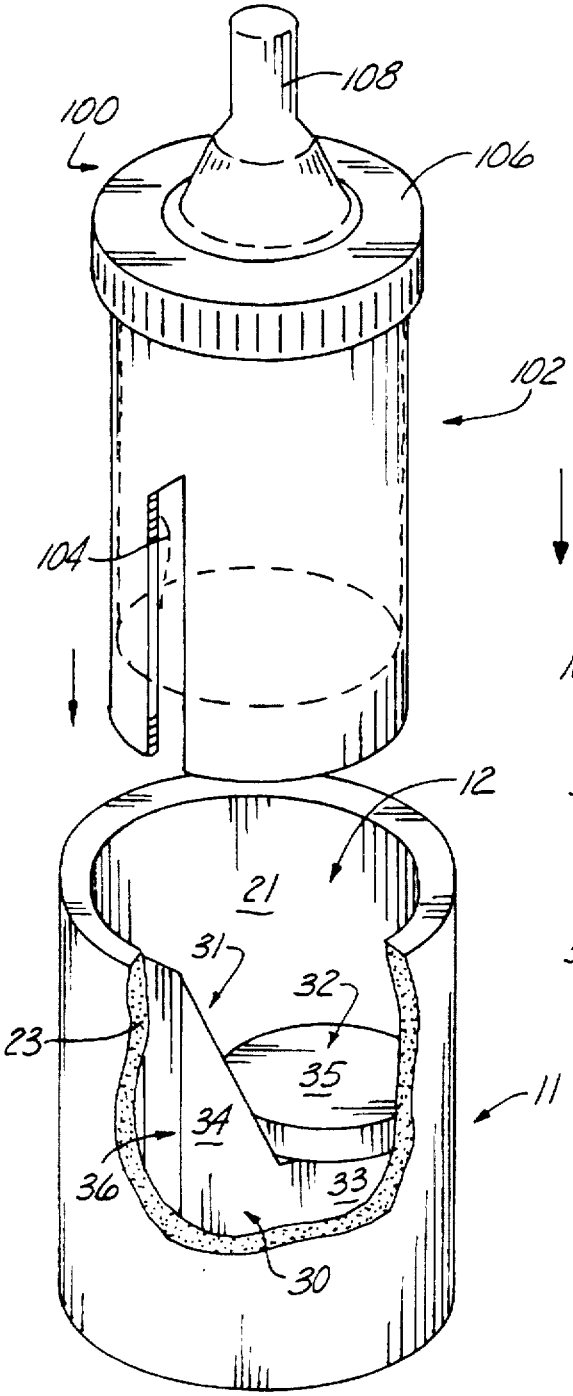
FIG. 2 is a partially cut-away view of the arrangement depicted in FIG. 1.
Figure 3:
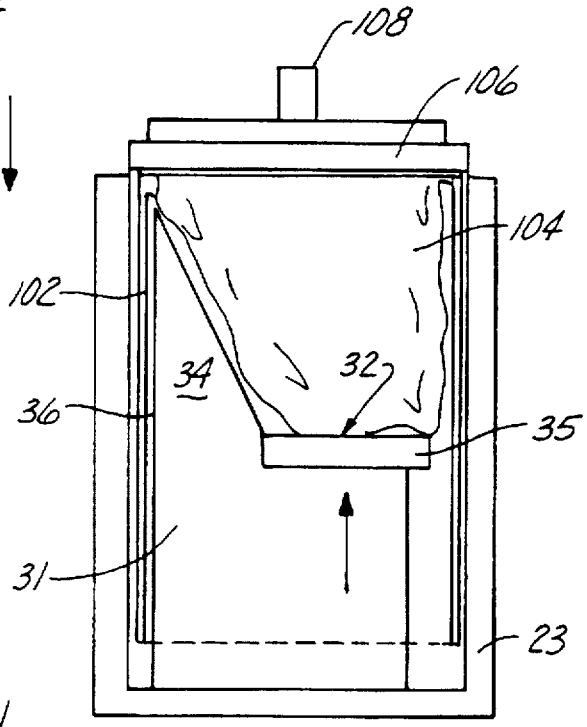
FIG. 3 is a cross-sectional view of the base unit showing the dual axis compression means.

As shown in FIGS. 1 through 3, the baby bottle 100 comprises the collapsible liner variety including an open ended cylindrical liner support member 102 which captively engages a collapsible liner 104 in cooperation with a cap element 106 provided with a replaceable nipple 108.

As is also shown in FIG. 1 through 3, the base unit 11 comprises a generally cylindrical insulated base member 20 wherein the sidewalls 21 and the bottom 22 of the base member 20 are fabricated from thermal insulating material 23, such as open or close celled foam or other material having suitable thermal insulating properties and characteristics.

As can also be seen by reference to FIG. 1 through 3, the base unit 11 is dimensioned to receive a dual axis compressive force applying unit 12 wherein the compressive force applying unit 12 includes an insert member 30 formed from a semirigid material and having a vertical support component 31 and a horizontal support component 32 wherein the vertical support component 31 includes a lower generally rectangular segment 33 and an upper generally triangular segment 34. The horizontal support component 32 includes a generally flat circular disk 35 which rests upon the top of the lower generally rectangular segment 33.

In the preferred embodiment of the invention depicted in FIGS. 2 and 3, it can be seen that the insert member 30 has an elongated vertical wall 36 disposed proximate to, but spaced from the side of the base member 20 and that the remainder of the insert member 30 is likewise spaced from the walls 21 of the base member 20 such that the base member 20 will slideably receive the liner support member 102 in a well recognized fashion.

When the liner support member 102 is inserted into the base member 20 one of the sides and bottom of the collapsible liner 104 will contact the angled surface of the vertical support component 31 and the circular disk 35 of the horizontal support component 32 respectively.

This contact will exert dual axis compressive forces on the collapsible liner 104 to reduce the effective volume of the collapsible liner 104 and drive entrained air out of the confines of the collapsible liner 104 and through the nipple 108 in a well recognized fashion.

In this manner, not only will the contents of the collapsible liner 104 be maintained close to the ideal temperature by the thermal insulating properties of the base member 20, but the contents of the collapsible liner 104 will constantly be subjected to the dual axis compression by the compressive force applying insert member 30 to purge entrapped air from within the confines of the liner 104.

Having thereby described the subject matter of the present invention, it should be apparent that many substitutions, modifications and variations of the invention are possible in light of the above teachings. It is therefore to be understood that the invention as taught and described herein is only to be limited to the extent of the breadth and scope of the appended claims.

I claim:

1. An improved baby bottle holder for use with a baby bottle having a collapsible liner suspended within an open ended cylindrical liner support member wherein the baby bottle holder comprises:

a base unit including a generally cylindrical base member dimensioned to receive said liner support member wherein the base member is provided with means for applying vertical and horizontal compressive forces to the conventional collapsible liner and wherein the base member is provided with an insert member having a vertical support component and a horizontal support component and said vertical support component includes an upper generally triangular segment which is disposed on one side of the base member and dimensioned to contact one side of the collapsible liner.

2. The baby bottle holder as in claim 1 wherein said horizontal support component includes a generally flat disk which is disposed adjacent the bottom of said triangular segment dimensioned to contact the bottom of the collapsible liner.

3. The baby bottle holder as in claim 1 wherein the liner support member is dimensioned to be received between the base member and the insert member.

4. The baby bottle holder as in claim 1 wherein the vertical support component also includes a generally rectangular lower portion.

5. The baby bottle holder as in claim 4 wherein said horizontal support component includes a generally flat disk which rests upon the generally rectangular lower portion of said vertical support component.

6. The baby bottle holder as in claim 1 wherein the base unit is fabricated from thermal insulating material.

* * * * *